US009903393B2

(12) United States Patent
Wu

(10) Patent No.: US 9,903,393 B2
(45) Date of Patent: Feb. 27, 2018

(54) CONSTRUCTION MACHINE

(71) Applicant: SUMITOMO HEAVY INDUSTRIES, LTD., Tokyo (JP)

(72) Inventor: Chunnan Wu, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 463 days.

(21) Appl. No.: 14/600,130

(22) Filed: Jan. 20, 2015

(65) Prior Publication Data

US 2015/0204359 A1 Jul. 23, 2015

(30) Foreign Application Priority Data

Jan. 22, 2014 (JP) ..... 2014-009842

(51) Int. Cl.

| | |
|---|---|
| ***F15B 11/17*** | (2006.01) |
| ***F15B 15/08*** | (2006.01) |
| ***E02F 9/22*** | (2006.01) |

(52) U.S. Cl.

CPC ..... *F15B 11/17* (2013.01); *E02F 9/2217* (2013.01); *E02F 9/2242* (2013.01); *E02F 9/2282* (2013.01); *E02F 9/2292* (2013.01); *E02F 9/2296* (2013.01); *F15B 15/08* (2013.01); *F15B 2211/20576* (2013.01); *F15B 2211/70* (2013.01)

(58) Field of Classification Search

CPC ..... F15B 11/17; E02F 9/2292; E02F 9/2217
USPC ..... 60/428, 414
See application file for complete search history.

(56) References Cited

U.S. PATENT DOCUMENTS

| | | | | |
|---|---|---|---|---|
| 9,194,107 | B2 * | 11/2015 | Andruch, III | E02F 9/2217 |
| 2012/0233997 | A1 * | 9/2012 | Andruch, III | E02F 9/2217 60/428 |
| 2013/0098013 | A1 | 4/2013 | Edler et al. | |
| 2013/0133966 | A1 | 5/2013 | Jiang et al. | |
| 2014/0212305 | A1 | 7/2014 | Krittian et al. | |

FOREIGN PATENT DOCUMENTS

| | | |
|---|---|---|
| DE | 102009033645 | 1/2011 |
| EP | 2735657 | 5/2014 |
| JP | S61-151341 | 7/1986 |
| JP | H01-178618 | 7/1989 |
| JP | 2007-228721 | 9/2007 |
| JP | 2008-128478 | 6/2008 |
| JP | 2013-023811 | 2/2013 |

* cited by examiner

*Primary Examiner* — Thomas E Lazo
(74) *Attorney, Agent, or Firm* — IPUSA, PLLC

(57) ABSTRACT

A construction machine includes a first hydraulic pump, a second hydraulic pump, and a hydraulic circuit. The first hydraulic pump supplies hydraulic oil to a hydraulic actuator of a first system. The second hydraulic pump supplies the hydraulic oil to a hydraulic actuator of a second system. The hydraulic circuit supplies the hydraulic oil flowing out from at least one of the hydraulic actuators of the first and second systems to the intake side or the discharge side of at least one of the first and second hydraulic pumps. At least one of the first and second hydraulic pumps operates as a hydraulic motor so as to assist the other of the first and second hydraulic pumps that operates as a hydraulic pump.

5 Claims, 8 Drawing Sheets

FIG.3

| OPERATION PATTERN | FIRST SELECTOR VALVE | SECOND SELECTOR VALVE | THIRD SELECTOR VALVE | FOURTH SELECTOR VALVE |
|---|---|---|---|---|
| ARM CLOSING | 2 | 1 | 1 | 1 |
| BOOM LOWERING | 1 | 2 | 1 | 1 |
| BUCKET CLOSING | 1 | 1 | 2 | 1 |
| TURNING STOP | 1 | 1 | 1 | 2 |
| ARM CLOSING + BOOM LOWERING | 2 | 2 | 1 | 1 |
| ARM CLOSING + BUCKET CLOSING | 2 | 1 | 2 | 1 |
| ARM CLOSING + TURNING STOP | 2 | 1 | 1 | 2 |
| BOOM LOWERING + BUCKET CLOSING | 1 | 2 | 2 | 1 |
| BOOM LOWERING + TURNING STOP | 1 | 2 | 1 | 2 |
| BUCKET CLOSING + TURNING STOP | 1 | 1 | 2 | 2 |
| ARM CLOSING + BOOM LOWERING + BUCKET CLOSING | 2 | 2 | 2 | 1 |
| ARM CLOSING + BOOM LOWERING + TURNING STOP | 2 | 2 | 1 | 2 |
| ARM CLOSING + BUCKET CLOSING + TURNING STOP | 2 | 1 | 2 | 2 |
| BOOM LOWERING + BUCKET CLOSING + TURNING STOP | 1 | 2 | 2 | 2 |
| ARM CLOSING + BOOM LOWERING + BUCKET CLOSING + TURNING STOP | 2 | 2 | 2 | 2 |

FIG.4

| P3 > P1? | P3 > P2? | SECOND HYDRAULIC PUMP LOAD STATE | P3 > Pth? | FIFTH SELECTOR VALVE | SIXTH SELECTOR VALVE | SEVENTH SELECTOR VALVE | SECOND HYDRAULIC PUMP OPERATING STATE |
|---|---|---|---|---|---|---|---|
| YES | YES | LOADED | – | 1 | 1 | 1 | PUMP |
| YES | NO | LOADED | – | 1 | 2 | 1 | PUMP |
| NO | YES | LOADED | – | 1 | 1 | 1 | PUMP |
| NO | NO | LOADED | – | 2 | – | 1 | PUMP |
| – | – | NO LOAD | YES | 2 | – | 2 | MOTOR |

FIG.7

| P3 > P1? | P3 > P2? | FIRST HYDRAULIC PUMP LOAD STATE | SECOND HYDRAULIC PUMP LOAD STATE | P3 > Pth? | FIFTH SELECTOR VALVE | SIXTH SELECTOR VALVE | SEVENTH SELECTOR VALVE | EIGHTH SELECTOR VALVE | NINTH SELECTOR VALVE | FIRST HYDRAULIC PUMP OPERATING STATE | SECOND HYDRAULIC PUMP OPERATING STATE |
|---|---|---|---|---|---|---|---|---|---|---|---|
| YES | YES | LOADED | LOADED | – | 1 | 1 | 1 | – | 1 | PUMP | PUMP |
| YES | NO | LOADED | LOADED | – | 1 | 2 | 1 | – | 1 | PUMP | PUMP |
| NO | YES | LOADED | LOADED | – | 1 | 1 | 1 | – | 1 | PUMP | PUMP |
| NO | NO | LOADED | LOADED | – | 2 | – | 1 | – | 1 | PUMP | PUMP |
| – | – | LOADED | NO LOAD | YES | 2 | – | 2 | 1 | 1 | PUMP | MOTOR |
| – | – | NO LOAD | LOADED | YES | 2 | – | 1 | 2 | 2 | MOTOR | PUMP |

CONSTRUCTION MACHINE

CROSS-REFERENCE TO RELATED APPLICATION

This application is based upon and claims the benefit of priority of Japanese Patent Application No. 2014-009842, filed on Jan. 22, 2014, the entire contents of which are incorporated herein by reference.

BACKGROUND

Technical Field

The present invention generally relates to construction machines that include a hydraulic actuator.

Description of Related Art

A shovel that drives a hydraulic actuator using hydraulic oil discharged by a hydraulic pump is known.

Normally, the hydraulic actuator receives hydraulic oil discharged by the hydraulic pump and discharges retained hydraulic oil to a hydraulic oil tank.

SUMMARY

According to an aspect of the present invention, a construction machine includes a first hydraulic pump, a second hydraulic pump, and a hydraulic circuit. The first hydraulic pump supplies hydraulic oil to a hydraulic actuator of a first system. The second hydraulic pump supplies the hydraulic oil to a hydraulic actuator of a second system. The hydraulic circuit supplies the hydraulic oil flowing out from at least one of the hydraulic actuators of the first and second systems to the intake side or the discharge side of at least one of the first and second hydraulic pumps. At least one of the first and second hydraulic pumps operates as a hydraulic motor so as to assist the other of the first and second hydraulic pumps that operates as a hydraulic pump.

It is to be understood that both the foregoing general description and the following detailed description are exemplary and explanatory and not restrictive of the invention.

BRIEF DESCRIPTION OF THE DRAWINGS

FIG. 3 is a diagram illustrating the correspondence between shovel operation patterns and valve positions of selector valves;

FIG. 4 is a diagram illustrating the correspondence between valve positions of selector valves and predetermined pressure conditions;

FIG. 7 is a diagram illustrating the correspondence between valve positions of selector valves and predetermined pressure conditions.

DETAILED DESCRIPTION

According to the above-described shovel, however, hydraulic oil flowing out from the hydraulic actuator may be discharged in a high-pressure state to the hydraulic oil tank, so that there is room for improvement in the way hydraulic energy is used.

According to an aspect of the present invention, a construction machine that can more efficiently reuse hydraulic oil flowing out from the hydraulic actuator is provided.

A description is given, with reference to the accompanying drawings, of an embodiment of the present invention.

Figure 1:
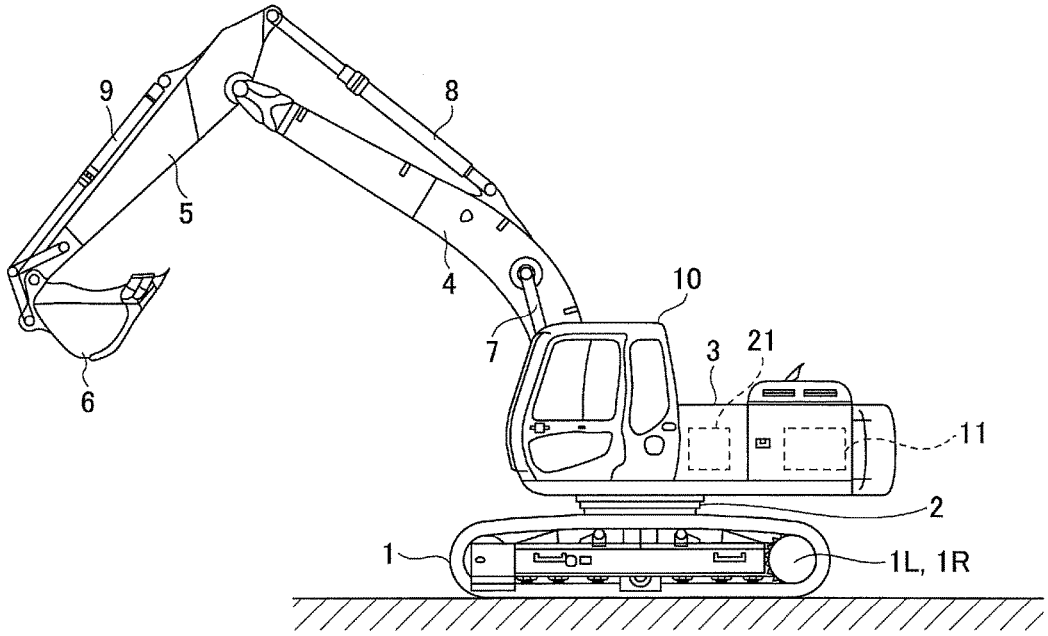
FIG. 1 is a side view of a shovel according to an embodiment of the present invention.

FIG. 1 is a side view of a shovel that is a construction machine according to the embodiment of the present invention. According to this embodiment, the shovel includes a lower-part traveling (movable) body 1, a turning mechanism 2 provided on the lower-part traveling body 1, and an upper-part turning (turnable) body 3 provided on the turning mechanism 2 so as to be turnable relative to the lower-part traveling body 1.

The upper-part turning body 3 includes an excavation attachment provided in its front center part. The excavation attachment includes a boom 4, an arm 5, a bucket 6, a boom cylinder 7 that drives the boom 4, an arm cylinder 8 that drives the arm 5, and a bucket cylinder 9 that drives the bucket 6. The upper-part turning body 3 further includes a cabin 10 into which an operator climbs provided in its front part and an engine 11 serving as a drive source provided in its rear part. In the following description, a left traveling hydraulic motor 1L, a right traveling hydraulic motor 1R, the boom cylinder 7, the arm cylinder 8, the bucket cylinder 9, a turning hydraulic motor 21, etc., are collectively referred to as "hydraulic actuators".

Figure 2:
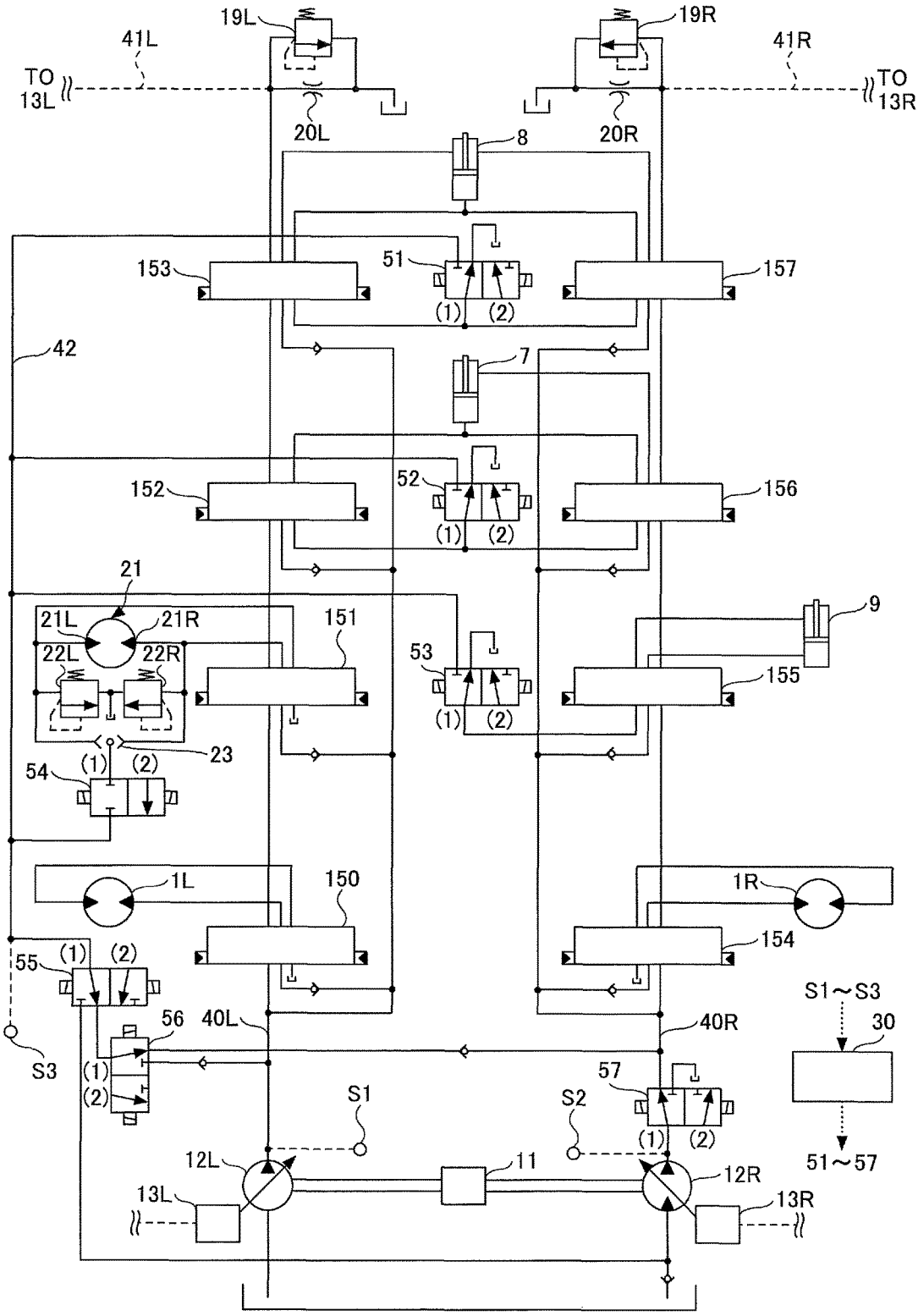
FIG. 2 is a schematic diagram illustrating a configuration of a hydraulic circuit provided in the shovel of FIG. 1.

FIG. 2 is a schematic diagram illustrating a configuration of a hydraulic circuit provided in the shovel of FIG. 1. In FIG. 2, high-pressure oil passages, pilot oil passages, and electrical control lines are indicated by a solid line, a broken line, and a dotted line, respectively.

According to this embodiment, the hydraulic circuit circulates hydraulic oil from first and second hydraulic pumps 12L and 12R driven by the engine 11 to a hydraulic oil tank via center bypass oil passages 40L and 40R, respectively.

The first hydraulic pump 12L is capable of supplying hydraulic oil to each of flow rate control valves 150, 151, 152 and 153 via a high-pressure oil passage. The second hydraulic pump 12R is capable of supplying hydraulic oil to each of flow rate control valves 154, 155, 156 and 157 via a high-pressure oil passage.

Specifically, the first and second hydraulic pumps 12L and 12R are, for example, swash-plate variable displacement hydraulic pumps. As indicated by double lines in FIG. 2, the first and second hydraulic pumps 12L and 12R have their respective rotating shafts connected to the drive shaft of the engine 11 so as to be rotated by the engine 11. According to this embodiment, negative control is employed as a pump control method for controlling the first and second hydraulic pumps 12L and 12R. Alternatively, other control methods such as positive control and load sensing control may be employed.

Furthermore, the second hydraulic pump 12R is operable as a hydraulic motor as well. According to this embodiment, when operating as a hydraulic motor, the second hydraulic pump 12R is rotated by hydraulic oil flowing out from at least one of the hydraulic actuators 7, 8, 9 and 21 so as to assist the engine 11.

Regulators 13L and 13R control the amounts of discharge of the first and second hydraulic pumps 12L and 12R, respectively. For example, the regulators 13L and 13R control the amounts of discharge per unit time of the first and second hydraulic pumps 12L and 12R by adjusting the tilting angles of the swash plates of the first and second hydraulic pumps 12L and 12R, respectively.

The center bypass oil passage 40L is a high-pressure oil passage that goes through the flow rate control valves 150 through 153, and includes a negative control throttle 20L between the flow rate control valve 153 and the hydraulic oil tank. The center bypass oil passage 40R is a high-pressure oil passage that goes through the flow rate control valves 154 through 157, and includes a negative control throttle 20R between the flow rate control valve 157 and the hydraulic oil tank.

The flows of hydraulic oil discharged by the first and second hydraulic pumps 12L and 12R are restricted by the negative control throttles 20L and 20R. Therefore, the negative control throttles 20L and 20R generate control pressures (hereinafter referred to as "negative control pressures") for controlling the regulators 13L and 13R, respectively.

Relief valves 19L and 19R are safety valves that control the negative control pressures to be lower than a predetermined relief pressure by discharging hydraulic oil to the hydraulic oil tank when the negative control pressures on the upstream side of the negative control throttles 20L and 20R become higher than or equal to the predetermined relief pressure.

Negative control pressure oil passages 41L and 41R are pilot oil passages for transmitting the negative control pressures generated on the upstream side of the negative control throttles 20L and 20R to the regulators 13L and 13R, respectively.

The regulators 13L and 13R control the amounts of discharge of the hydraulic pumps 12L and 12R by adjusting the tilting angles of the swash plates of the hydraulic pumps 12L and 12R in accordance with the negative control pressures. Furthermore, the regulators 13L and 13R decrease the amounts of discharge of the hydraulic pumps 12L and 12R as the introduced negative control pressures increase, and increase the amounts of discharge of the hydraulic pumps 12L and 12R as the introduced negative control pressures decrease.

The flow rate control valve 150 is a spool valve for supplying hydraulic oil discharged by the first hydraulic pump 12L to the left traveling hydraulic motor 1L and discharging hydraulic oil flowing out from the left traveling hydraulic motor 1L to the hydraulic oil tank. The flow rate control valve 154 is a spool valve for supplying hydraulic oil discharged by the second hydraulic pump 12R to the right traveling hydraulic motor 1R and discharging hydraulic oil flowing out from the right traveling hydraulic motor 1R to the hydraulic oil tank.

The flow rate control valve 151 is a spool valve for supplying hydraulic oil discharged by the first hydraulic pump 12L to the turning hydraulic motor 21 and discharging hydraulic oil flowing out from the turning hydraulic motor 21 to the hydraulic oil tank.

The flow rate control valve 155 is a spool valve for supplying hydraulic oil discharged by the second hydraulic pump 12R to the bucket cylinder 9 and discharging hydraulic oil flowing out from the bucket cylinder 9 to the hydraulic oil tank.

The flow rate control valves 152 and 156 are spool valves for supplying hydraulic oil discharged by the first and second hydraulic pumps 12L and 12R to the boom cylinder 7 and discharging hydraulic oil flowing out from the boom cylinder 7 to the hydraulic oil tank. The flow rate control valve 152 is a spool valve that operates every time a boom operation lever (not graphically represented) is operated. The flow rate control valve 156 is a spool valve that operates only when the boom operation lever is operated in a direction to raise the boom 4 with a predetermined amount of lever operation or more.

The flow rate control valves 153 and 157 are spool valves for supplying hydraulic oil discharged by the first and second hydraulic pumps 12L and 12R to the arm cylinder 8 and discharging hydraulic oil flowing out from the arm cylinder 8 to the hydraulic oil tank. The flow rate control valve 157 is a valve that operates every time an arm operation lever (not graphically represented) is operated. The flow rate control valve 153 is a valve that operates only when the arm operation lever is operated with a predetermined amount of lever operation or more.

According to this embodiment, the left traveling hydraulic motor 1L, the turning hydraulic motor 21, the boom cylinder 7, and the arm cylinder 8 that operate using hydraulic oil discharged by the first hydraulic pump 12L are referred to as "hydraulic actuators of a first system," and the flow rate control valves 150 through 153 are referred to as "flow rate control valves of the first system." Furthermore, the right traveling hydraulic motor 1R, the boom cylinder 7, the arm cylinder 8, and the bucket cylinder 9 that operate using hydraulic oil discharged by the second hydraulic pump 12R are referred to as "hydraulic actuators of a second system," and the flow rate control valves 154 through 157 are referred to as "flow rate control valves of the second system."

A controller 30 is a control unit for controlling the hydraulic circuit. The controller 30 is, for example, a computer that includes a central processing unit (CPU), a random access memory (RAM), and a read-only memory (ROM). According to this embodiment, the controller 30 receives the detection results of various kinds of sensors, performs a predetermined operation based on the received detection results, and controls a first selector valve 51, a second selector valve 52, a third selector valve 53, a fourth selector valve 54, a fifth selector valve 55, a sixth selector valve 56, and a seventh selector valve 57 in accordance with the result of the operation.

The first through seventh selector valves 51 through 57 operate in accordance with control instructions from the controller 30. According to this embodiment, the first through fourth selector valves 51 through 54 are connected to a high-pressure oil passage 42. Furthermore, the fourth selector valve 54 is a two-port, two-position solenoid selector valve, and the other selector valves are three-port, two-position solenoid selector valves. The first through seventh selector valves 51 through 57 may be hydraulic selector valves.

Specifically, the first position of the first selector valve 51 causes the outlet ports of the flow rate control valves 153 and 157 to communicate with the hydraulic oil tank, and the second position of the first selector valve 51 causes the outlet ports of the flow rate control valves 153 and 157 to communicate with the high-pressure oil passage 42. This configuration makes it possible for the first selector valve 51 to switch discharging hydraulic oil flowing out from the flow rate control valves 153 and 157 directly to the hydraulic oil tank and delivering hydraulic oil flowing out from the flow rate control valves 153 and 157 to the high-pressure oil passage 42. In FIG. 2, parenthesized numbers associated with the first selector valve 51 represent valve positions, and (1) corresponds to the first position and (2) corresponds to the second position. The same applies to the other selector valves 52 through 57.

Furthermore, the first position of the second selector valve 52 causes the outlet ports of the flow rate control valves 152 and 156 to communicate with the hydraulic oil tank, and the second position of the second selector valve 52 causes the outlet ports of the flow rate control valves 152 and 156 to communicate with the high-pressure oil passage 42. This configuration makes it possible for the second selector valve 52 to switch discharging hydraulic oil flowing out from the flow rate control valves 152 and 156 directly to the hydraulic oil tank and delivering hydraulic oil flowing out from the flow rate control valves 152 and 156 to the high-pressure oil passage 42.

Furthermore, the first position of the third selector valve 53 causes the outlet ports of the flow rate control valves 151 and 155 to communicate with the hydraulic oil tank, and the second position of the third selector valve 53 causes the outlet ports of the flow rate control valves 151 and 155 to communicate with the high-pressure oil passage 42. This configuration makes it possible for the third selector valve 53 to switch discharging hydraulic oil flowing out from the flow rate control valves 151 and 155 directly to the hydraulic oil tank and delivering hydraulic oil flowing out from the flow rate control valves 151 and 155 to the high-pressure oil passage 42.

Each of the first through third selector valves 51 through 53 may be provided between the associated cylinder and the associated flow rate control valves. In this case, each of the first through third selector valves 51 through 53 is switched between a first position at which hydraulic oil flowing out from the associated cylinder is discharged to the hydraulic oil tank via the associated flow rate control valves and a second position at which hydraulic oil flowing out from the associated cylinder is delivered to the high-pressure oil passage 42 without going through the associated flow rate control valves.

Furthermore, the first position of the fourth selector valve 54 disconnects a turning hydraulic circuit and the high-pressure oil passage 42, and the second position of the fourth selector valve 54 causes the turning hydraulic circuit to communicate with the high-pressure oil passage 42. The turning hydraulic circuit is a hydraulic circuit including relief valves 22L and 22R and a shuttle valve 23. The relief valve 22L causes hydraulic oil on a first port 21L side of the turning hydraulic motor 21 to flow out to the hydraulic oil tank when the pressure of hydraulic oil on the first port 21L side exceeds a predetermined relief pressure. The relief valve 22R causes hydraulic oil on a second port 21R side of the turning hydraulic motor 21 to flow out to the hydraulic oil tank when the pressure of hydraulic oil on the second port 21R side exceeds a predetermined relief pressure. Furthermore, the shuttle valve 23 causes one of the hydraulic oil on the first port 21L side and the hydraulic oil on the second port 21R side that is higher in pressure to flow out to the fourth selector valve 54. This configuration makes it possible for the fourth selector valve 54 to cause hydraulic oil on the discharge side of the turning hydraulic motor 21 to flow out to the high-pressure oil passage 42 at the time of decelerating the turning mechanism 2.

Furthermore, the first position of the fifth selector valve 55 causes the high-pressure oil passage 42 to communicate with the discharge side (downstream side) of the first hydraulic pump 12L or the second hydraulic pump 12R, and the second position of the fifth selector valve 55 causes the high-pressure oil passage 42 to communicate with the intake side (upstream side) of the second hydraulic pump 12R. This configuration makes it possible for the fifth selector valve 55 to switch merging hydraulic oil flowing out from the high-pressure oil passage 42 with hydraulic oil discharged from the first hydraulic pump 12L or the second hydraulic pump 12R (on its downstream side) and merging hydraulic oil flowing out from the high-pressure oil passage 42 with hydraulic oil taken into the second hydraulic pump 12R (on its upstream side).

Furthermore, the first position of the sixth selector valve 56 causes the fifth selector valve 55 to communicate with the discharge side (downstream side) of the second hydraulic pump 12R, and the second position of the sixth selector valve 56 causes the fifth selector valve 55 to communicate with the discharge side (downstream side) of the first hydraulic pump 12L. This configuration makes it possible for the sixth selector valve 56 to switch merging hydraulic oil flowing out from the high-pressure oil passage 42 with hydraulic oil discharged from the second hydraulic pump 12R (on its downstream side) and merging hydraulic oil flowing out from the high-pressure oil passage 42 with hydraulic oil discharged from the first hydraulic pump 12L (on its downstream side).

Furthermore, the first position of the seventh selector valve 57 causes a discharge port of the second hydraulic pump 12R to communicate with the center bypass oil passage 40R, and the second position of the seventh selector valve 57 causes the discharge port of the second hydraulic pump 12R to communicate with the hydraulic oil tank. This configuration makes it possible for the seventh selector valve 57 to switch delivering hydraulic oil flowing out from the discharge port of the second hydraulic pump 12R to the center bypass oil passage 40R and discharging hydraulic oil flowing out from the discharge port of the second hydraulic pump 12R directly to the hydraulic oil tank.

The shovel illustrated in FIG. 2 is operated using an operation apparatus (not graphically illustrated). The operation apparatus includes an arm operation lever, a boom operation lever, a bucket operation lever, a turning operation lever, and right and left traveling levers (or traveling pedals). The operation apparatus introduces a pilot pressure corresponding to the amount of lever operation or pedal operation into a right or left pilot port of a corresponding one or more flow rate control valves, using hydraulic oil discharged by a control pump (not graphically illustrated).

Specifically, the arm operation lever for operating the arm 5 introduces a pilot pressure corresponding to the amount of lever operation into a right or left pilot port of each of the flow rate control valves 153 and 157. Furthermore, the boom operation lever for operating the boom 4 introduces a pilot pressure corresponding to the amount of lever operation into a right or left pilot port of each of the flow rate control valves 152 and 156. Furthermore, the bucket operation lever for operating the bucket 6 introduces a pilot pressure corresponding to the amount of lever operation into a right or left pilot port of the flow rate control valve 155. Furthermore, the turning operation lever for turning the upper-part turning body 3 introduces a pilot pressure corresponding to the amount of lever operation into a right or left pilot port of the flow rate control valve 151. The right and left traveling levers (or traveling pedals) for causing the lower-part traveling body 1 to travel introduce a pilot pressure corresponding to the amount of lever operation or pedal operation into a right or left pilot port of the flow rate control valve 154 and a right or left pilot port of the flow rate control valve 150, respectively.

Furthermore, the shovel illustrated in FIG. 2 detects the amount of operation of the operation apparatus using an operation amount detection part. The operation amount detection part includes an arm pilot pressure sensor, a boom pilot pressure sensor, a bucket pilot pressure sensor, a turning pilot pressure sensor, and a traveling pilot pressure sensor (none of which is graphically illustrated). The operation amount detection part detects the amount of lever operation or the amount of pedal operation as the pressure value of a pilot pressure, and outputs the detected value to the controller 30.

Specifically, the arm pilot pressure sensor detects the amount of lever operation of the arm operation lever as the pressure value of a pilot pressure. Furthermore, the boom pilot pressure sensor detects the amount of lever operation of the boom operation lever as the pressure value of a pilot pressure. Furthermore, the bucket pilot pressure sensor detects the amount of lever operation of the bucket operation lever as the pressure value of a pilot pressure. Furthermore, the turning pilot pressure sensor detects the amount of lever operation of the turning operation lever as the pressure value of a pilot pressure. Furthermore, the traveling pilot pressure sensor detects the amount of lever or pedal operation of each of the right and left traveling levers or pedals as the pressure value of a pilot pressure.

Pressure sensors S1, S2 and S3 detect the pressure of hydraulic oil, and output their respective detected values to the controller 30.

Specifically, the pressure sensor S1 detects the discharge pressure of the first hydraulic pump 12L, the pressure sensor S2 detects the discharge pressure of the second hydraulic pump 12R, and the pressure sensor S3 detects the pressure of hydraulic oil inside the high-pressure oil passage 42.

Next, a description is given, with reference to FIG. 2 and FIG. 3, of an operation of the controller 30 controlling the switching of the first through fourth selector valves 51 through 54 in accordance with a detection result of the operation amount detection part in order to collect hydraulic oil having reusable hydraulic energy (hereinafter referred to as "hydraulic oil collecting operation"). FIG. 3 is a diagram illustrating the correspondence between shovel operation patterns and the valve positions of the first through fourth selector valves 51 through 54. Furthermore, it is assumed that the valve positions of the first through fourth selector valves 51 through 54 are switched to the respective first positions.

In the case where the shovel operation pattern is "arm closing," that is, when the arm pilot pressure sensor detects the operation of the arm operation lever in a direction to close the arm 5, the controller 30 switches the valve position of the first selector valve 51 to the second position.

This is because hydraulic oil flowing out from the arm cylinder 8 has reusable hydraulic energy in the case of performing "arm closing" using the own weight of the arm 5.

The controller 30 maintains the valve positions of the second through fourth selector valves 52 through 54 in the first positions because the boom cylinder 7, the bucket cylinder 9, and the turning hydraulic motor 21 are causing no hydraulic oil having reusable hydraulic energy to flow out.

As a result, the hydraulic oil flowing out from the arm cylinder 8 is delivered to the high-pressure oil passage 42 via at least one of the flow rate control valves 153 and 157 and via the first selector valve 51.

Furthermore, in the case where the shovel operation pattern is "boom lowering," that is, when the boom pilot sensor detects the operation of the boom operation lever in a direction to lower the boom 4, the controller 30 switches the valve position of the second selector valve 52 to the second position.

This is because hydraulic oil flowing out from the boom cylinder 7 has reusable hydraulic energy in the case of performing "boom lowering" using the own weight of the boom 4.

The controller 30 maintains the valve positions of the first, third and fourth selector valves 51, 53 and 54 in the first positions because the arm cylinder 8, the bucket cylinder 9, and the turning hydraulic motor 21 are causing no hydraulic oil having reusable hydraulic energy to flow out.

As a result, the hydraulic oil flowing out from the boom cylinder 7 is delivered to the high-pressure oil passage 42 via at least one of the flow rate control valves 152 and 156 and via the second selector valve 52.

Furthermore, in the case where the shovel operation pattern is "bucket closing," that is, when the bucket pilot pressure sensor detects the operation of the bucket operation lever in a direction to close the bucket 6, the controller 30 switches the valve position of the third selector valve 53 to the second position.

This is because hydraulic oil flowing out from the bucket cylinder 9 has reusable hydraulic energy in the case of performing "bucket closing" using the own weight of the bucket 6.

The controller 30 maintains the valve positions of the first, second and fourth selector valves 51, 52 and 54 in the first positions because the boom cylinder 7, the arm cylinder 8, and the turning hydraulic motor 21 are causing no hydraulic oil having reusable hydraulic energy to flow out.

As a result, the hydraulic oil flowing out from the bucket cylinder 9 is delivered to the high-pressure oil passage 42 via the flow rate control valve 155 and the third selector valve 53.

Furthermore, in the case where the shove operation pattern is "turning stop," that is, when the turning pilot pressure sensor detects the operation of the turning operation lever in a direction to stop the turning of the upper-part turning body 3, the controller 30 switches the valve position of the fourth selector valve 54 to the second position.

This is because hydraulic oil on the discharge side of the turning hydraulic motor 21 has reusable hydraulic energy in the case of performing "turning stop" by limiting the amount of hydraulic oil flowing out from the turning hydraulic motor 21.

The controller 30 maintains the valve positions of the first through third selector valves 51 through 53 in the first positions because the boom cylinder 7, the arm cylinder 8, and the bucket cylinder 9 are causing no hydraulic oil having reusable hydraulic energy to flow out.

As a result, the hydraulic oil on the discharge side of the turning hydraulic motor 21 is delivered to the high-pressure oil passage 42 via the fourth selector valve 54.

In addition, the shove operation pattern may be a combination of two or more of the above-described four operation patterns, namely, "arm closing," "boom lowering," "bucket closing," and "turning stop" as illustrated in FIG. 3. The valve positions of the first through fourth selector valves 51 through 54 in the case where the shovel operation pattern is a combination of two or more of the operation patterns are a combination of the valve positions of the individual operation patterns.

Next, a description is given, with reference to FIG. 2, FIG. 4 and FIG. 5, an operation of the controller 30 merging reusable hydraulic oil collected in the hydraulic oil collecting operation with a proper point of the hydraulic circuit (hereinafter referred to as "merge point switching operation"). According to this embodiment, the controller 30 controls the switching of the fifth through seventh selector valves 55 through 57 in accordance with detection results of the operation amount detection part and the pressure sensors S1 through S3 in the merge point switching operation. FIG. 4 is a diagram illustrating the correspondence between predetermined pressure conditions and the valve positions of the fifth through seventh selector valves 55 through 57. Furthermore, a pressure P1 represents the discharge pressure of the first hydraulic pump 12L, a pressure P2 represents the discharge pressure of the second hydraulic pump 12R, and a pressure P3 represents the pressure of hydraulic oil of the high-pressure oil passage 42. Furthermore, in "Second Hydraulic Pump Load State," "Loaded" means that at least one of the flow rate control valves 154 through 157 of the second system is in operation, that is, at least one of the hydraulic actuators of the second system is in operation, and "No Load" means that none of the flow rate control valves 154 through 157 of the second system is in operation, that is, none of the hydraulic actuators of the second system is in operation. Furthermore, a threshold pressure value Pth is the pressure of hydraulic oil of the high-pressure oil passage 42 that is required to cause the second hydraulic pump 12R to operate as a hydraulic motor, and is, for example, 10 MPa. Furthermore, "Second Hydraulic Pump Operating State" indicates whether the second hydraulic pump 12R is operating as a hydraulic pump or a hydraulic motor. It is assumed that the second hydraulic pump 12R is currently operating as a hydraulic pump.

Figure 5:
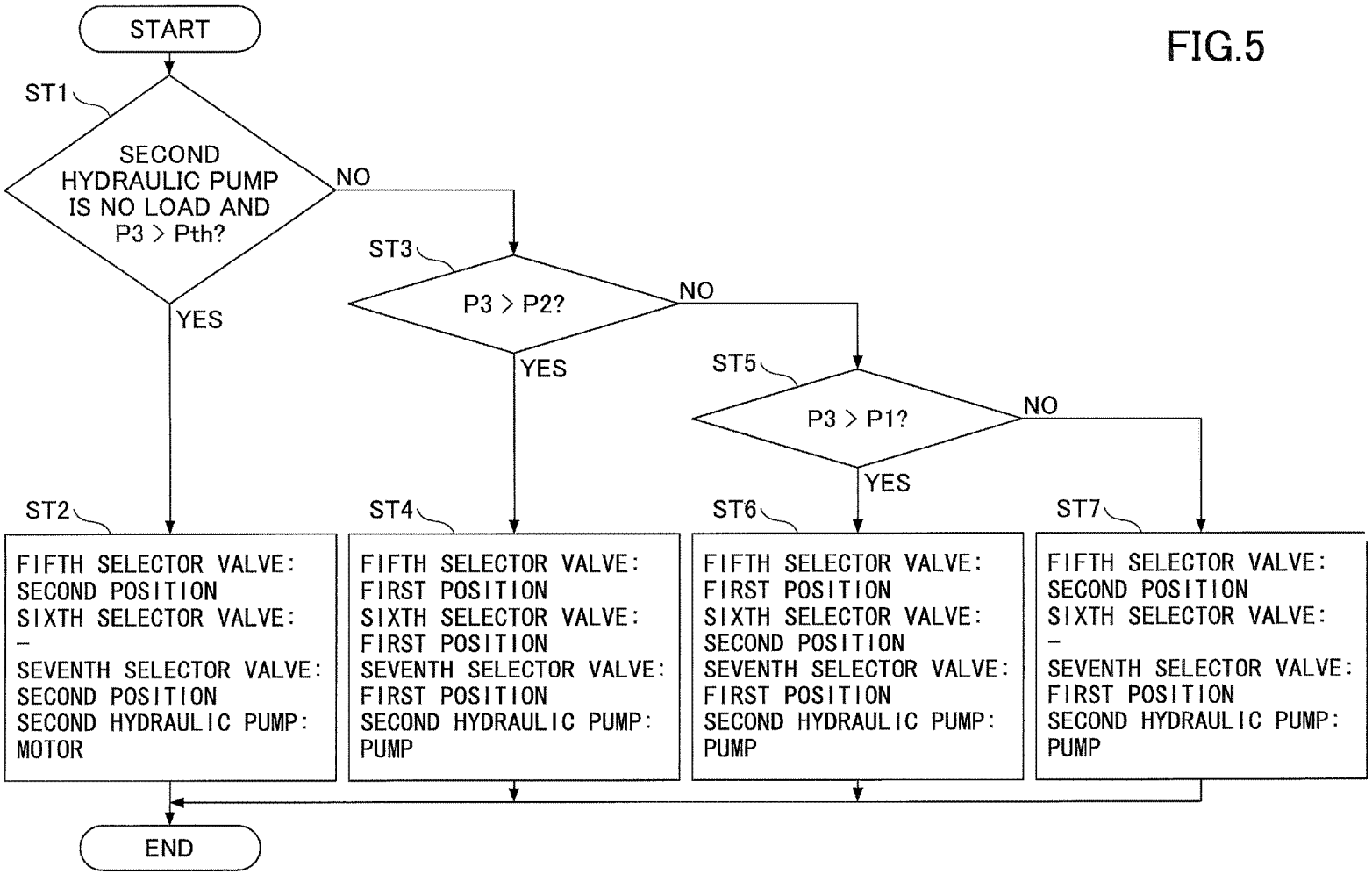
FIG. 5 is a flowchart illustrating an example of a merge point switching operation.

FIG. 5 is a flowchart illustrating an example of the merge point switching operation. The controller 30 repeatedly performs the merge point switching operation at regular control intervals.

First, at step ST1, the controller 30 determines whether the load state of the second hydraulic pump 12R is "No Load" and the pressure P3 of hydraulic oil of the high-pressure oil passage 42 is greater than the threshold pressure value Pth.

If the load state of the second hydraulic pump 12R is "No Load" (that is, the second hydraulic pump 12R is unloaded) and the pressure P3 of hydraulic oil of the high-pressure oil passage 42 is greater than the threshold pressure value Pth (YES at step ST1), at step ST2, the controller 30 switch the valve position of each of the fifth and seventh selector valves 55 and 57 to the second position so as to cause the second hydraulic pump 12R to operate as a hydraulic motor.

As a result of this setting, hydraulic oil flowing out from the high-pressure oil passage 42 is supplied to the intake side (upstream side) of the second hydraulic pump 12R. The second hydraulic pump 12R is rotated as a hydraulic motor by the hydraulic oil flowing out from the high-pressure oil passage 42 so as to assist the first hydraulic pump 12L operating as a hydraulic pump. As a result, it is possible for the first hydraulic pump 12L to increase its maximum absorption horsepower determined in accordance with the maximum allowable output of the engine 11, or it is possible for the second hydraulic pump 12R as a hydraulic motor to reduce a load on the engine 11 related to the operation of the first hydraulic pump 12L.

Hydraulic oil flowing out from the second hydraulic pump 12R rotated as a hydraulic motor is discharged to the hydraulic oil tank through the second position of the seventh selector valve 57.

In this case, the sixth selector valve 56 may be in either the first position or the second position because no hydraulic oil of the high-pressure oil passage 42 arrives at the sixth selector valve 56 through the fifth selector valve 55. In FIG. 4, "-" in the column of "Sixth Selector Valve" indicates that the valve position of the sixth selector valve 56 is either the first position or the second position. The same applies to "-" in FIG. 5.

On the other hand, in response to determining that the second hydraulic pump 12R is "Loaded" or the pressure P3 is less than or equal to the threshold pressure value Pth (NO at step ST1), at step ST3, the controller 30 determines whether the pressure P3 is greater than the discharge pressure P2 of the second hydraulic pump 12R.

In response to determining that the pressure P3 is greater than the discharge pressure P2 (YES at step ST3), at step ST4, the controller 30 maintains the state as is. Specifically, the controller 30 maintains the fifth through seventh selector valves 55 through 57 in their respective first positions, and causes the second hydraulic pump 12R to continue to operate as a hydraulic pump.

As a result of this setting, hydraulic oil flowing out from the high-pressure oil passage 42 arrives at the downstream side of the seventh selector valve 57 through the fifth and sixth selector valves 55 and 56 so as to merge with hydraulic oil discharged by the second hydraulic pump 12R. As a result, it is possible for the second hydraulic pump 12R to reduce the amount of discharge for causing the hydraulic actuators of the second system to operate.

Furthermore, in response to determining that the pressure P3 is less than or equal to the discharge pressure P2 (NO at step ST3), at step ST5, the controller 30 determines whether the pressure P3 is greater than the discharge pressure P1 of the first hydraulic pump 12L.

In response to determining that the pressure P3 is greater than the discharge pressure P1 (YES at step ST5), at step ST6, the controller 30 switches the valve position of the sixth selector valve 56 to the second position. Specifically, the controller 30 switches the valve position of the sixth selector valve 56 to the second position while maintaining the fifth and seventh selector valves 55 and 57 in the first positions and causing the second hydraulic pump 12R to continue to operate as a hydraulic pump.

As a result of this setting, hydraulic oil flowing out from the high-pressure oil passage 42 arrives at the discharge side (downstream side) of the first hydraulic pump 12L through the fifth and sixth selector valves 55 and 56 so as to merge with hydraulic oil discharged by the first hydraulic pump 12L. As a result, it is possible for the first hydraulic pump 12L to reduce the amount of discharge for causing the hydraulic actuators of the first system to operate.

In response to determining that the pressure P3 is less than or equal to the discharge pressure P1 (NO at step ST5), at step ST7, the controller 30 switches the valve position of the fifth selector valve 55 to the second position. Specifically, the controller 30 switches the valve position of the fifth selector valve 55 to the second position while maintaining the seventh selector valve 57 in the first position and causing the second hydraulic pump 12R to continue to operate as a hydraulic pump. In this case, the sixth selector valve 56 may be in either the first position or the second position because no hydraulic oil of the high-pressure oil passage 42 arrives at the sixth selector valve 56 through the fifth selector valve 55.

As a result of this setting, hydraulic oil flowing out from the high-pressure oil passage 42 is supplied to the intake side (upstream side) of the second hydraulic pump 12R. The second hydraulic pump 12R operates as a hydraulic pump while taking in hydraulic oil flowing out from the high-pressure oil passage 42. As a result, it is possible for the second hydraulic pump 12R to take in and discharge to the downstream side hydraulic oil having higher hydraulic pressure than hydraulic oil taken in from the hydraulic oil tank and to reduce a loan on the engine 11 related to the operation of the second hydraulic pump 12R.

In the above-described embodiment, of the two hydraulic pumps 12L and 12R, only the second hydraulic pump 12R can operate as a hydraulic motor. Alternatively, of the two hydraulic pumps 12L and 12R, only the first hydraulic pump 12L may operate as a hydraulic motor. In this case, the fifth selector valve 55 is configured to switch merging hydraulic oil flowing out from the high-pressure oil passage 42 with hydraulic oil discharged from the first hydraulic pump 12L or the second hydraulic pump 12R (on its downstream side) and merging hydraulic oil flowing out from the high-pressure oil passage 42 with hydraulic oil taken into the first hydraulic pump 12L (on its upstream side). Furthermore, the seventh selector valve 57 is configured to switch delivering hydraulic oil flowing out from a discharge port of the first hydraulic pump 12L to the center bypass oil passage 40L and discharging hydraulic oil flowing out from the discharge port of the first hydraulic pump 12L directly to the hydraulic oil tank.

Figure 6:
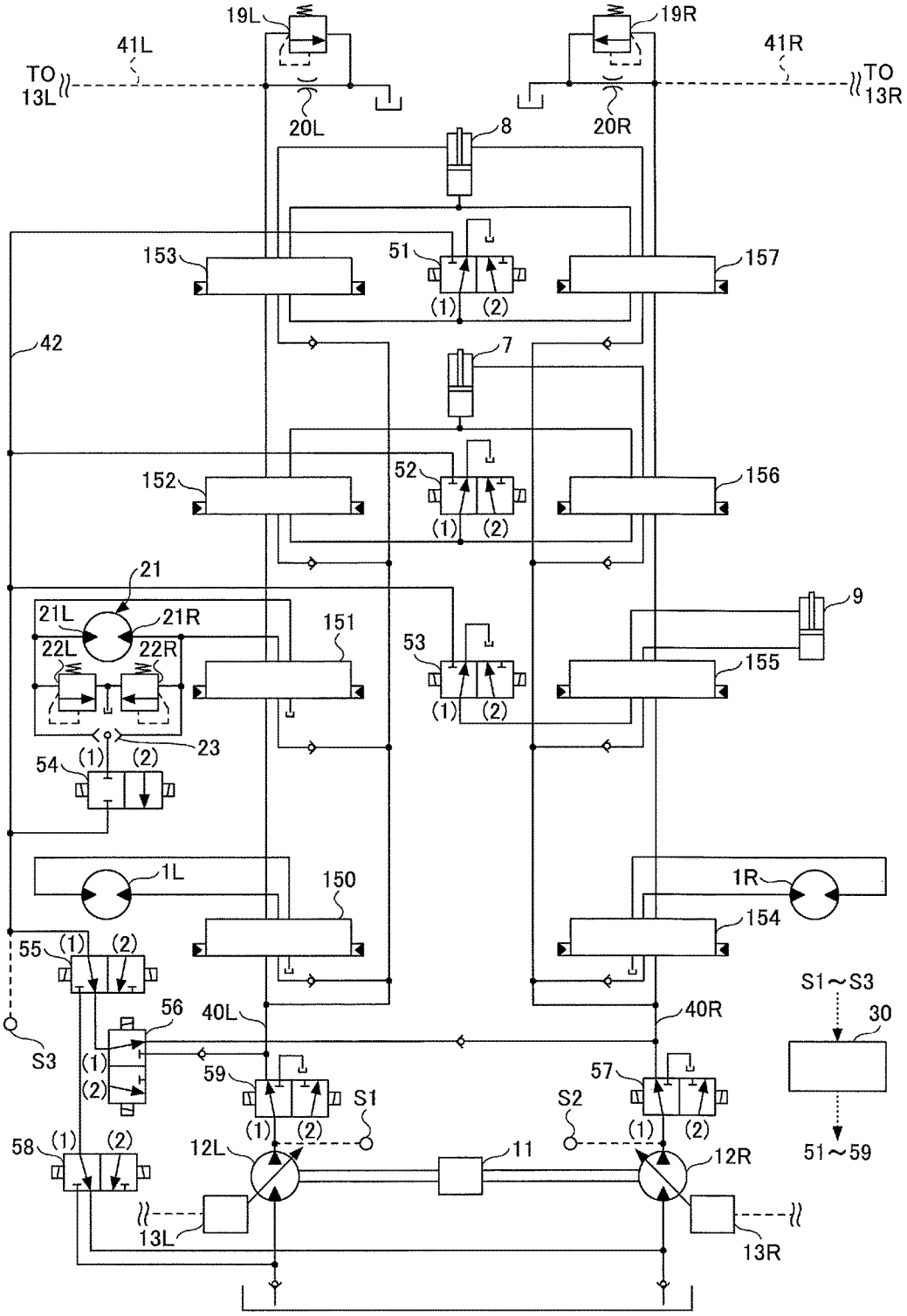
FIG. 6 is a schematic diagram illustrating another configuration of the hydraulic circuit provided in the shovel of FIG. 1.
Figure 8:
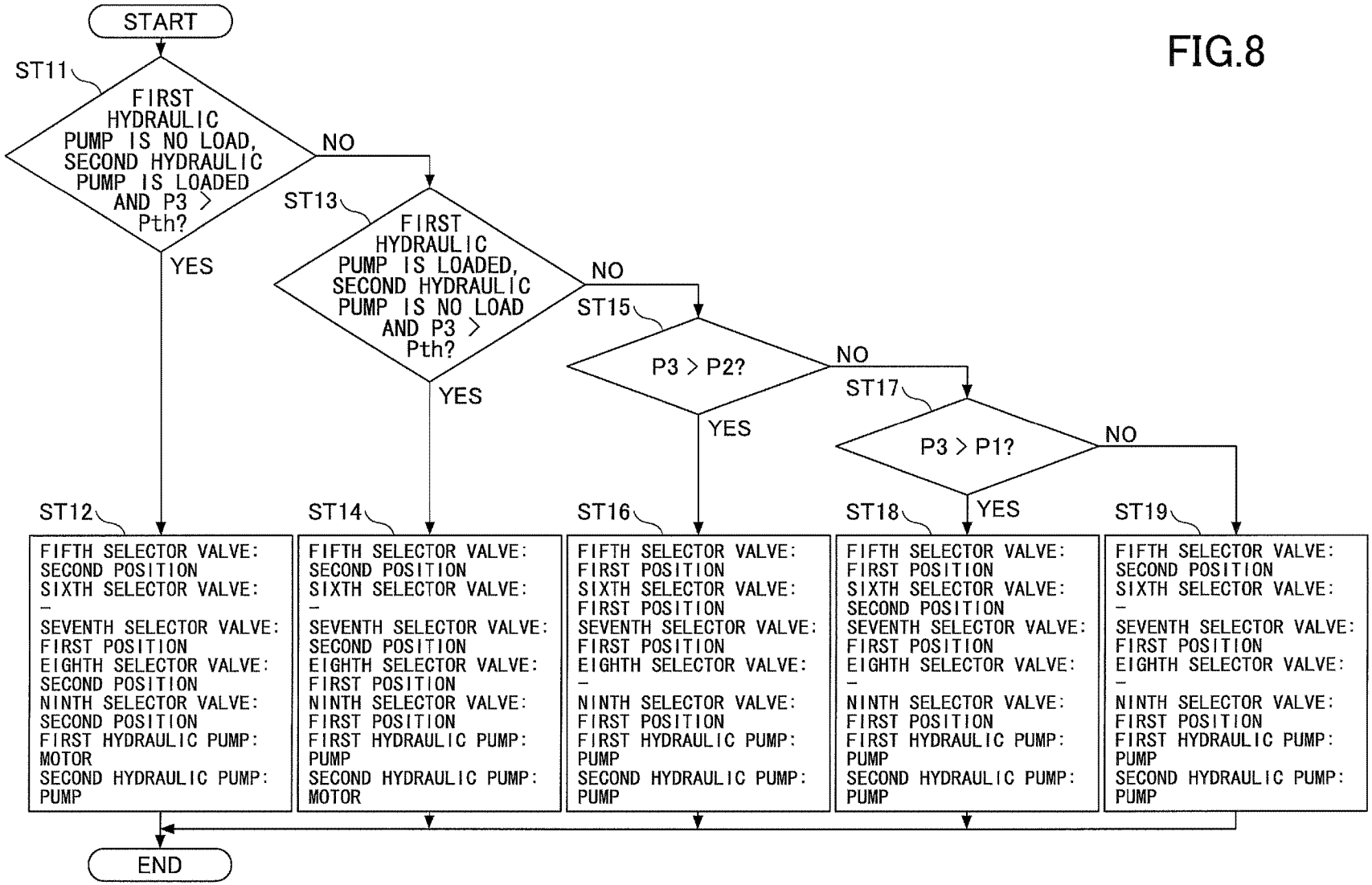
FIG. 8 is a flowchart illustrating another example of the merge point switching operation.

Next, a description is given, with reference to FIG. 6, FIG. 7 and FIG. 8, of an operation of another hydraulic circuit provided in the shovel according to the embodiment of the present invention. FIG. 6 is a schematic diagram illustrating a configuration of another hydraulic circuit provided in the shovel of FIG. 1. The hydraulic circuit of FIG. 6 is the same as the hydraulic circuit of FIG. 2 except that the first hydraulic pump 12L can operate as a hydraulic motor and that an eighth selector valve 58 and a ninth selector valve 59 are further provided. Therefore, a description of configurations common to the hydraulic circuits of FIG. 2 and FIG. 6 is omitted.

The eighth selector valve 598 and the ninth selector valve 59 operate in accordance with control instructions from the controller 30. According to this embodiment, the eighth and ninth selector valves 58 and 59 are three-port, two-position solenoid selector valves. The eighth and ninth selector valves 58 and 59 may alternatively be hydraulic selector valves.

Specifically, the first position of the eighth selector valve 58 causes the fifth selector valve 55 to communicate with the intake side (upstream side) of the second hydraulic pump 12R. Furthermore, the second position of the eighth selector valve 58 causes the fifth selector valve 55 to communicate with the intake side (upstream side) of the first hydraulic pump 12L. This configuration makes it possible for the eighth selector valve 58 to switch merging hydraulic oil flowing out from the high-pressure oil passage 42 through the fifth selector valve 55 with hydraulic oil taken into the first hydraulic pump 12L (on its upstream side) and merging hydraulic oil flowing out from the high-pressure oil passage 42 through the fifth selector valve 55 with hydraulic oil taken into the second hydraulic pump 12R (on its upstream side).

Furthermore, the first position of the ninth selector valve 59 causes the discharge port of the first hydraulic pump 12L to communicate with the center bypass oil passage 40L, and the second position of the ninth selector valve 59 causes the discharge port of the first hydraulic pump 12L to communicate with the hydraulic oil tank. This configuration makes it possible for the ninth selector valve 59 to switch delivering hydraulic oil flowing out from the discharge port of the first hydraulic pump 12L to the center bypass oil passage 40L and discharging hydraulic oil flowing out from the discharge port of the first hydraulic pump 12L directly to the hydraulic oil tank.

FIG. 7 is a diagram illustrating the correspondence between predetermined pressure conditions and the valve positions of the fifth through ninth selector valves 55 through 59, and corresponds to FIG. 4. FIG. 8 is a flowchart illustrating another example of the merge point switching operation, and corresponds to FIG. 5. Specifically, determinations at steps ST15 and ST17 in FIG. 8 are equal to those at steps ST3 and ST5, respectively, of FIG. 5. Furthermore, the valve positions of the fifth through seventh selector valves 55 through 57 and the operating state of the second hydraulic pump 12R at steps ST14, ST16, ST18 and ST19 are equal to those at steps ST2, ST4, ST6 and ST7, respectively, of FIG. 5. Therefore, a description is given of determinations at steps ST11 and ST13 and settings at step S12. It is assumed that both the first and second hydraulic pumps 12L and 12R are operating as hydraulic pumps.

First, at step ST11, the controller 30 determines whether the load state of the first hydraulic pump 12L is "No Load," the load state of the second hydraulic pump 12R is "Loaded" and the pressure P3 of hydraulic oil of the high-pressure oil passage 42 is greater than the threshold pressure value Pth.

In response to determining that the load state of the first hydraulic pump 12L is "No Load," the load state of the second hydraulic pump 12R is "Loaded" and the pressure P3 is greater than the threshold pressure value Pth (YES at step ST11), at step ST12, the controller 30 switches the valve positions of the fifth, eighth and ninth selector valves 55, 58 and 59 to their respective second positions so as to cause the first hydraulic pump 12L to operate as a hydraulic motor.

As a result of this setting, hydraulic oil flowing out from the high-pressure oil passage 42 is supplied to the intake side (upstream side) of the first hydraulic pump 12L. The first hydraulic pump 12L is rotated as a hydraulic motor by the hydraulic oil flowing out from the high-pressure oil passage 42 so as to assist the second hydraulic pump 12R operating as a hydraulic pump. As a result, it is possible for the second hydraulic pump 12R to increase its maximum absorption horsepower deter mined in accordance with the maximum allowable output of the engine 11, or it is possible for the first hydraulic pump 12L as a hydraulic motor to reduce a load on the engine 11 related to the operation of the second hydraulic pump 12R.

Hydraulic oil flowing out from the first hydraulic pump 12L rotated as a hydraulic motor is discharged to the hydraulic oil tank through the second position of the ninth selector valve 59.

In this case, the sixth selector valve 56 may be in either the first position or the second position because no hydraulic oil of the high-pressure oil passage 42 arrives at the sixth selector valve 56 through the fifth selector valve 55.

On the other hand, in response to determining that the load state of the first hydraulic pump 12L is "Loaded", the load state of the second hydraulic pump 12R is "No Load," or the pressure P3 is less than or equal to the threshold pressure value Pth (NO at step ST11), at step ST13, the controller 30 determines whether the load state of the first hydraulic pump 12L is "Loaded," the load state of the second hydraulic pump 12R is "No Load," and the pressure P3 of hydraulic oil of the high-pressure oil passage 42 is greater than the threshold pressure value Pth.

In response to determining that the load state of the first hydraulic pump 12L is "Loaded," the load state of the second hydraulic pump 12R is "No Load," and the pressure P3 is greater than the threshold pressure value Pth (YES at step ST13), at step ST14, the controller 30 switches the valve positions of the fifth and seventh selector valves 55 and 57 to the second positions so as to cause the second hydraulic pump 12R to operate as a hydraulic motor.

As a result of this setting, hydraulic oil flowing out from the high-pressure oil passage 42 is supplied to the intake side (upstream side) of the second hydraulic pump 12R. The second hydraulic pump 12R is rotated as a hydraulic motor by the hydraulic oil flowing out from the high-pressure oil passage 42 so as to assist the first hydraulic pump 12L operating as a hydraulic pump. As a result, it is possible for the first hydraulic pump 12L to increase its maximum absorption horsepower determined in accordance with the maximum allowable output of the engine 11, or it is possible for the second hydraulic pump 12R as a hydraulic motor to reduce a load on the engine 11 related to the operation of the first hydraulic pump 12L.

Hydraulic oil flowing out from the second hydraulic pump 12R rotated as a hydraulic motor is discharged to the hydraulic oil tank through the second position of the seventh selector valve 57.

Furthermore, at steps ST16, ST18 and ST19, the controller 30 maintains the ninth selector valve 59 in the first position and causes the first hydraulic pump 12L to continue to operate as a hydraulic pump. Furthermore, at steps ST16 and ST18, the eighth selector valve 58 may be in either the first position or the second position because no hydraulic oil of the high-pressure oil passage 42 arrives at the eighth selector valve 58 through the fifth selector valve 55. In FIG. 7, "-" in the column of "Eighth Selector Valve" indicates that the valve position of the eighth selector valve 58 is either the first position or the second position. The same applies to "-" in FIG. 8. Furthermore, at step ST19, the eighth selector valve 58 may be in either the first position or the second position because hydraulic oil from the high-pressure oil passage 42 may be merged with hydraulic oil taken in by either the first hydraulic pump 12L or the second hydraulic pump 12R.

According to the above-described configuration, it is possible for the shovel according to the embodiment of the present invention to merge hydraulic oil flowing out from a hydraulic actuator with hydraulic oil on the intake side (upstream side) or the discharge side (downstream side) of a hydraulic pump in accordance with the pressure of the hydraulic oil flowing out from a hydraulic actuator. Therefore, it is possible to efficiently reuse hydraulic oil flowing out from a hydraulic actuator and to save energy.

Furthermore, it is possible for the shovel according to the embodiment of the present invention to cause the second hydraulic pump 12R to operate as a hydraulic motor in the case of merging hydraulic oil flowing out from a hydraulic actuator with hydraulic oil on the intake side (upstream side) of the second hydraulic pump 12R. Accordingly, it is possible to cause the first hydraulic pump 12L to operate as a hydraulic pump, using the driving force of the engine 11 and the driving force of the second hydraulic pump 12R operating as a hydraulic motor. As a result, it is possible to increase the maximum absorption horsepower of the first hydraulic pump 12L or reduce a load on the engine 11 related to the operation of the first hydraulic pump 12L.

Furthermore, the shovel according to the embodiment of the present invention merges hydraulic oil flowing out from a hydraulic actuator with hydraulic oil on the discharge side (downstream side) of a hydraulic pump when the pressure of the hydraulic oil flowing out from a hydraulic actuator is higher than the discharge pressure of the hydraulic pump, and merges hydraulic oil flowing out from a hydraulic actuator with hydraulic oil on the intake side (upstream side) of a hydraulic pump when the pressure of the hydraulic oil flowing out from a hydraulic actuator is lower than the discharge pressure of the hydraulic pump. Therefore, even when the pressure of hydraulic oil flowing out from a hydraulic actuator is lower than the discharge pressure of a hydraulic pump, it is possible to reuse the hydraulic oil to reduce a load on the hydraulic pump.

In the above-described embodiment, the controller 30 compares the pressure P3 of hydraulic oil of the high-pressure oil passage 42 and the discharge pressure P1 of the first hydraulic pump 12L after comparing the pressure P3 and the discharge pressure P2 of the second hydraulic pump 12R. Alternatively, the controller 30 may compare the pressure P3 and the discharge pressure P2 after comparing the pressure P3 and the discharge pressure P1. As yet another alternative, the controller 30 may compare the pressure P3 with the lower of the discharge pressure P1 and the discharge pressure P2 after comparing the pressure P3 with the higher of the discharge pressure P1 and the discharge pressure P2.

All examples and conditional language provided herein are intended for pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

For example, in the above-described embodiment, the operation amount detection part detects the amount of lever operation of an operation lever as the pressure value of a pilot pressure. Alternatively, the amount of operation may be detected as other physical quantity (such as a voltage, electric current or angle) using other sensors such as a potentiometer.

Furthermore, in the above-described embodiment, the flow rate control valves 150 through 157 are spool valves that operate in accordance with a pilot pressure. Alternatively, the flow rate control valves 150 through 157 may be solenoid spool valves that operate in accordance with a control instruction from the controller 30.

Furthermore, the shovel may be provided with a turning electric motor in place of a turning hydraulic motor.

Furthermore, the construction machine according to the embodiment of the present invention may also be a lifting magnet, a crane, a high reach demolition machine or the like.

What is claimed is:

1. A shovel, comprising:

a lower-part traveling body;

an upper-part turning body turnably provided on the lower-part traveling body;

an engine provided on the upper-part turning body;

a first hydraulic pump configured to be driven by an output of the engine to supply hydraulic oil to a hydraulic actuator of a first system;

a second hydraulic pump configured to be driven by the output of the engine to supply the hydraulic oil to a hydraulic actuator of a second system; and a hydraulic circuit that supplies the hydraulic oil flowing out from at least one of the hydraulic actuator of the first system and the hydraulic actuator of the second system to an intake side or a discharge side of at least one of the first hydraulic pump and the second hydraulic pump, wherein at least one of the first hydraulic pump and the second hydraulic pump operates as a hydraulic motor so as to assist the other of the first hydraulic pump and the second hydraulic pump that operates as a hydraulic pump, and wherein a check valve is provided between said at least one of the first hydraulic pump and the second hydraulic pump that operates as the hydraulic motor and a tank of the hydraulic oil on the intake side of said at least one of the first hydraulic pump and the second hydraulic pump that operates as the hydraulic motor to prevent the hydraulic oil from flowing to the tank.

2. The shovel as claimed in claim 1, wherein when the second hydraulic pump is unloaded and a pressure of the hydraulic oil flowing out from the hydraulic actuator of the first system is greater than a threshold, the hydraulic circuit merges the hydraulic oil flowing out from the hydraulic actuator of the first system with the hydraulic oil on the intake side of the second hydraulic pump, and the second hydraulic pump operates as the hydraulic motor so as to assist the first hydraulic pump operating as the hydraulic pump.

3. The shovel as claimed in claim 1, wherein when the second hydraulic pump is loaded or a pressure of the hydraulic oil flowing out from the hydraulic actuator of the first system is less than or equal to a threshold, and the pressure is higher than a discharge pressure of the second hydraulic pump, the hydraulic circuit merges the hydraulic oil flowing out from the hydraulic actuator of the first system with the hydraulic oil on the discharge side of the second hydraulic pump, and the second hydraulic pump operates as the hydraulic pump.

4. The shovel as claimed in claim 1, wherein when the second hydraulic pump is loaded or a pressure of the hydraulic oil flowing out from the hydraulic actuator of the first system is less than or equal to a threshold, and the pressure is lower than or equal to a discharge pressure of each of the first hydraulic pump and the second hydraulic pump, the hydraulic circuit merges the hydraulic oil flowing out from the hydraulic actuator of the first system with the hydraulic oil on the intake side of the second hydraulic pump, and the second hydraulic pump operates as the hydraulic pump.

5. The shovel as claimed in claim 1, wherein the hydraulic circuit includes an oil passage that is connected between said at least one of the first hydraulic pump and the second hydraulic pump that operates as the hydraulic motor and the check valve on the intake side of said at least one of the first hydraulic pump and the second hydraulic pump that operates as the hydraulic motor.

* * * * *